United States Patent [19]

Schwalb

[11] Patent Number: 4,671,191

[45] Date of Patent: Jun. 9, 1987

[54] AIR-COOLED COMBUSTION CHAMBER WALL

[75] Inventor: Max Schwalb, Eisenberg, Fed. Rep. of Germany

[73] Assignee: Didier-Werke AG, Wiesbaden, Fed. Rep. of Germany

[21] Appl. No.: 905,750

[22] Filed: Sep. 9, 1986

[30] Foreign Application Priority Data

Sep. 18, 1985 [DE] Fed. Rep. of Germany ..... 3533240

[51] Int. Cl.[4] ..... F23M 5/00

[52] U.S. Cl. ..... 110/336; 110/338; 431/167

[58] Field of Search ..... 110/336, 338, 337, 305, 110/314; 431/164, 165, 167

[56] References Cited

U.S. PATENT DOCUMENTS

| | | | |
|---|---|---|---|
| 907,682 | 12/1908 | Cotton | 110/336 X |
| 907,683 | 12/1908 | Cotton | 110/336 |
| 4,543,893 | 10/1985 | Kunnecke | 110/138 |

FOREIGN PATENT DOCUMENTS

| | | |
|---|---|---|
| 17372 | 4/1904 | Austria . |
| 430733 | 6/1926 | Fed. Rep. of Germany . |
| 2317064 | 11/1977 | Fed. Rep. of Germany . |
| 1565691 | 5/1969 | France . |

OTHER PUBLICATIONS

"Beitrag zur Berechnung des Wasserumlaufs in Dampfkesseln", Unschau im Fachgebiet, No. 24, 1933, p. 385.

*Primary Examiner*—Edward G. Favors
*Attorney, Agent, or Firm*—Nils H. Ljungman

[57] ABSTRACT

The invention relates to an air-cooled combustion chamber wall for combustion furnaces. The combustion chamber wall comprises at least one masonry wall with a space in the middle for the passage of cooling air along the side of the wall away from the combustion chamber side. To create a simple, stable and effective structure, the invention proposes that the masonry be made of bricks, whose walls enclose at least one air duct.

19 Claims, 4 Drawing Figures

AIR-COOLED COMBUSTION CHAMBER WALL

BACKGROUND OF THE INVENTION 1. Field of the Invention

The invention relates to an air-cooled combustion chamber wall for combustion furnaces and, more specifically, to walls for combustion furnaces for waste combustion installations.

These walls, according to an embodiment of the invention, comprise at least one masonry wall, with a space in the middle, for the passage of cooling air along one side of the wall away from the combustion chamber side. 2. Description of the Prior Art The prior art includes combustion chamber walls of this type, in which two masonry walls erected at a distance from one another are connected by means of individual spacers. Individual slits are opened to the combustion chamber side, through which air is introduced into the combustion chamber. Such structures are not very stable. Federal Republic of Germany Pat. No. DE-PS 23 17 064 describes an air-cooled combustion chamber wall, which is designed as a metal wall through which air passes, which is equipped on the combustion chamber side with air discharge openings, whereby there is a metal plate wall in front of the hollow walls on the combustion chamber side, at some distance, and whereby the cavity in the hollow walls, whose air discharge openings in the inner jacket empty into the space between the inner jacket and the external plate wall, is in communication with the combustion chamber through openings in the plate wall, offset in relation to the above-mentioned openings. The purpose of this arrangement, on one hand, is so that no temperatures are reached on the inner wall surfaces near the combustion zone which lead to the melting of ash, and to achieve a significant reduction of the outside temperature. Such steel structures are limited to a maximum use temperature of approximately 600° C. They consume large quantities of air for cooling, and are therefore extraordinarily expensive to operate.

Other examples of prior art are German Pat. No. DE-PS 430 733, Austrian Pat. No. AT-PS 17 372 and French Pat. No. FR-PS 1,565,691, and the article "Neue Hohlwände für Kesselfeuerungen in Umschau im Fachgebiet", No. 24, June 17, 1933, p. 385. All of the above-mentioned patent specifications and the publication are incorporated by reference as if the entire texts thereof were set forth herein in their entirety.

OBJECTS OF THE INVENTION

An object of the present invention is to provide a combustion chamber wall of the type described above, which results in a more stable and more effective wall structure.

Another object of the present invention is to provide a combustion chamber wall at a lower cost.

Yet another object of the present invention is to provide a combustion chamber wall which has lower operating costs than those of the prior art.

SUMMARY OF THE INVENTION

These objects are achieved by the invention in that the masonry wall is constructed of bricks, whose walls always enclose an air duct which is in a flow communication with corresponding air ducts of neighboring bricks. Such a masonry wall is simple and economical to erect, and results in a stable structure. Because of the large cooling surfaces which result, there is an effective reduction of the surface temperature with a relatively low consumption of air, and thereby a reduction of slag or other products present in the furnace during firing which adheres to the wall on the combustion chamber side. Excessive insulation can be avoided, since the air transported through the air ducts of the bricks serves as an effective insulator. The expensive steel structure is unnecessary.

The reduction of the surface temperature of the wall surface on the combustion chamber side is particularly favorable if the surface of the wall of the brick on the combustion chamber side is smaller than the opposite side of the brick facing the air duct. This can be achieved, for example, in accordance with another characteristic of the invention, if the wall surface facing the air duct in question exhibits a surface structure which increases the surface area.

The surface structure which increases the surface area can, for example, be groove-like recesses, which run in the longitudinal direction of the duct, so that when there is a great deal of surface activity, there will be no significant adverse effect on the flow resistance for the air flowing in the ducts. Such groove-like recesses can also be made very easily.

With a high combustion chamber load, the air duct of each brick can also be configured in two or three passages by means of partitions running in the direction of the airflow. The heat exchange with the air can thereby be improved, especially if the surfaces of the partitions also exhibit a surface structure which increases the surface area.

Insert structures, similar to a Cowper system, can also be inserted into the air ducts or passages to increase the surface area.

To assure a uniform removal of heat by pressure equalization between the individual air ducts, in one particular configuration of the invention, there are communication ducts between the air ducts of adjacent bricks and/or the passages.

There can also be air inflow ducts between the air ducts and the combustion chamber itself. Through these inflow ducts, the cooling air can enter the combustion chamber, so that it is available as secondary air for the afterburning of the exhaust gases. Since the secondary air is already heated in the air ducts, there is a good mixing action of the exhaust gases, a further reduction of the wall temperatures of the combustion chamber, and therefore, an additional obstacle to the adherence of slag.

According to the invention, the communication ducts and/or the air inflow ducts can be produced most easily by groove-like recesses in the end surfaces of the bricks, which can be expanded, if necessary, with corresponding groove-like recesses in the bricks immediately adjacent above and below into ducts with a larger cross section.

To improve the stability of the wall structure, the bricks can be staggered, that is, offset in relation to one another from layer to layer.

Another characteristic feature of the invention is that adjacent bricks are engaged with one another by means of serrations. The serration can be between adjacent bricks in a single row of bricks, or between the end surfaces of the bricks facing one another in adjacent rows, to achieve a high stability of the wall structure.

To increase the service life of such a wall structure, a specific configuration of the invention provides that the wall of the brick facing the combustion chamber is thicker than its side walls.

It is particularly advantageous if, between or on the bricks, there are blocks which do not contain any air ducts, to hold anchoring elements and/or to close off the air ducts. In this manner, without major structural expense, the combustion chamber wall can be mounted on a rear support, for example, a steel structure. In addition, the blocks can be used to close off the top and the bottom of the air ducts, that is, as a sort of floor and/or ceiling.

The blocks can also be engaged with the bricks by means of serrations, as described above.

The serration of the bricks and/or of the blocks can be achieved relatively easily by tongue and groove joints in the external surface of the side walls and/or the end walls of the blocks.

Both the bricks and also the blocks preferably have a height, depth and width which, respectively, are in increments of 64 mm, 125 mm, and 250 mm, or a multiple of these values. The bricks and blocks, according to the invention, thereby fit into a standard format grid (brick format), so that they can be enlarged without additional structural modifications, etc., in the same grid pattern.

The bricks and/or blocks preferably comprise SiC, a material which has proven reliable for combustion chamber walls. Because of the thermal conduction, the invention also proposes that the bricks and/or blocks be mortared by means of refractory mortar containing SiC.

In summing up, one aspect of the invention resides broadly in an air-cooled wall of a combustion furnace. The wall comprises a plurality of brick means disposed one substantially adjacent another. At least a portion of the brick means comprises brick. Each brick has at least one passage being disposed within and extending through its corresponding brick for passing cooling air therethrough. Each brick has at least one inner surface and at least one outer surface. One of the at least one outer surface comprises at least one surface disposed adjacent a combustion area of the combustion furnace. The at least one passage comprises at least a portion of the at least one inner surface. The at least one air passage is disposed when the plurality of bricks form a wall, such that, the at least one air passage is disposed to accept air from an adjacent one of the bricks and pass at least a portion of the air to another, also adjacent, one of the bricks. Each brick has means for forming at least one air connection. The at least one air connection is connected to at least one of the air passages. The at least one air connection for connecting at least one of the air passages to the at least one outer surface is disposed adjacent a combustion area of the combustion furnace. The means for forming the at least one air connection is disposed, in said wall, adjacent to a corresponding means for forming an air connection of an adjacent brick in the wall.

Another aspect of the invention resides broadly in an air-cooled wall of a combustion furnace. The wall comprises a plurality of bricks disposed one substantially adjacent another. Each brick has at least one passage being disposed within and extending through its corresponding brick for passing cooling air therethrough. Each brick has at least one inner surface and at least one outer surface. One of the at least one outer surface comprises at least one surface disposed adjacent a combustion area of the combustion furnace. The at least one passage comprises at least a portion of the at least one inner surface. The at least one air passage is disposed when the plurality of bricks form a wall, such that, the at least one air passage is disposed to accept air from an adjacent one of the bricks and pass at least a portion of the air to another, also adjacent, one of the bricks. Each brick has means for forming at least one air connection. The at least one air connection is connected to at least one of the air passages. The at least one air connection is for connecting at least one of the air passages to another of the air ducts. The means for forming the at least one air connection is disposed, in said wall, adjacent to a corresponding means for forming an air connection of an adjacent brick.

Other objectives, features, advantages and possible applications of the present invention will become apparent on the basis of the following description of embodiments, with reference to the attached drawing. All the characteristics described and/or depicted are therefore part of the object of the invention, individually or in any reasonable combination, regardless of their manner in which they are combined in the claims or references made to them.

DESCRIPTION OF THE PREFERRED EMBODIMENTS

Figure 1:
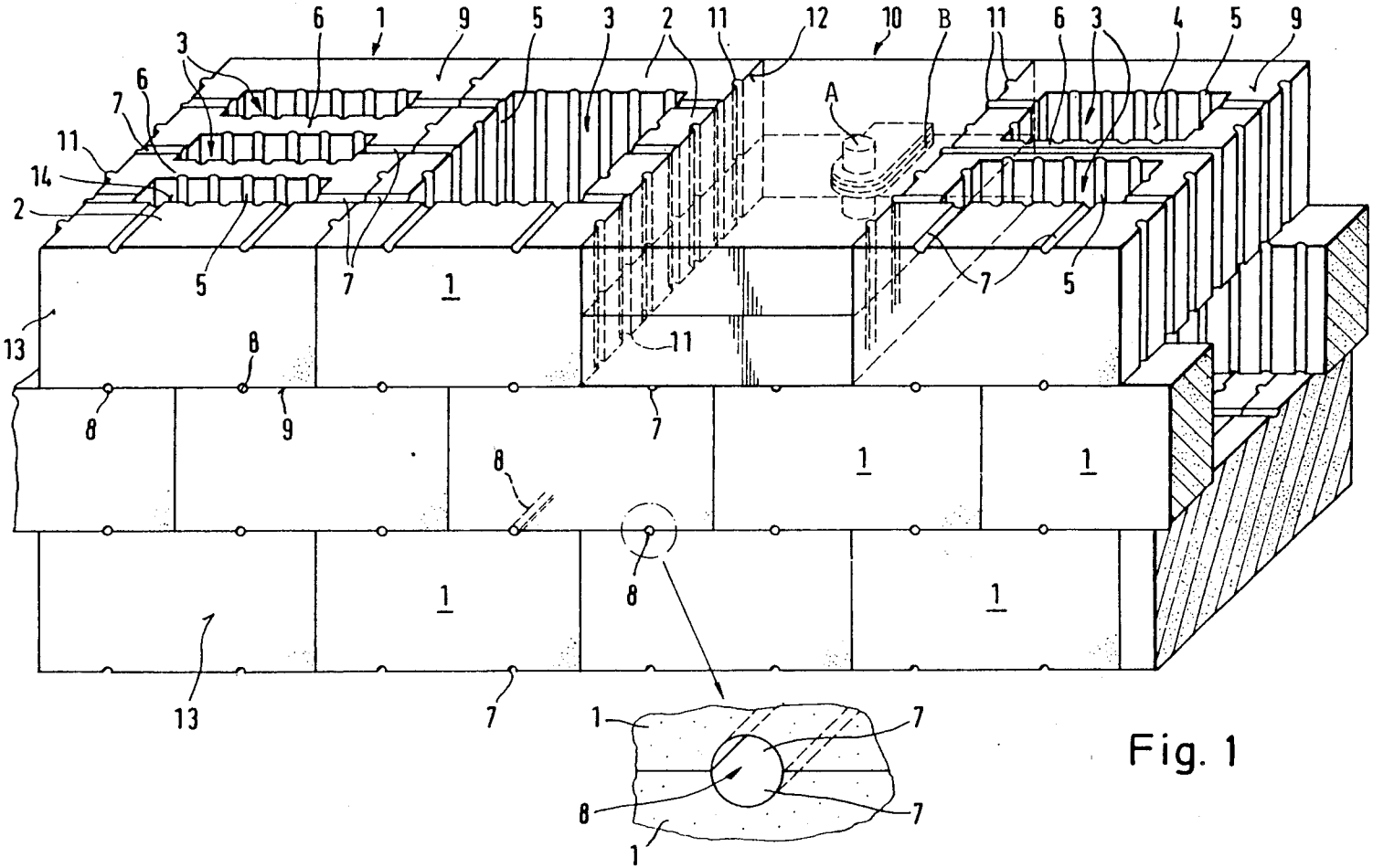
FIG. 1 shows, in perspective and partly cutaway, a section of a combustion chamber wall according to an embodiment of the invention.
Figure 2:
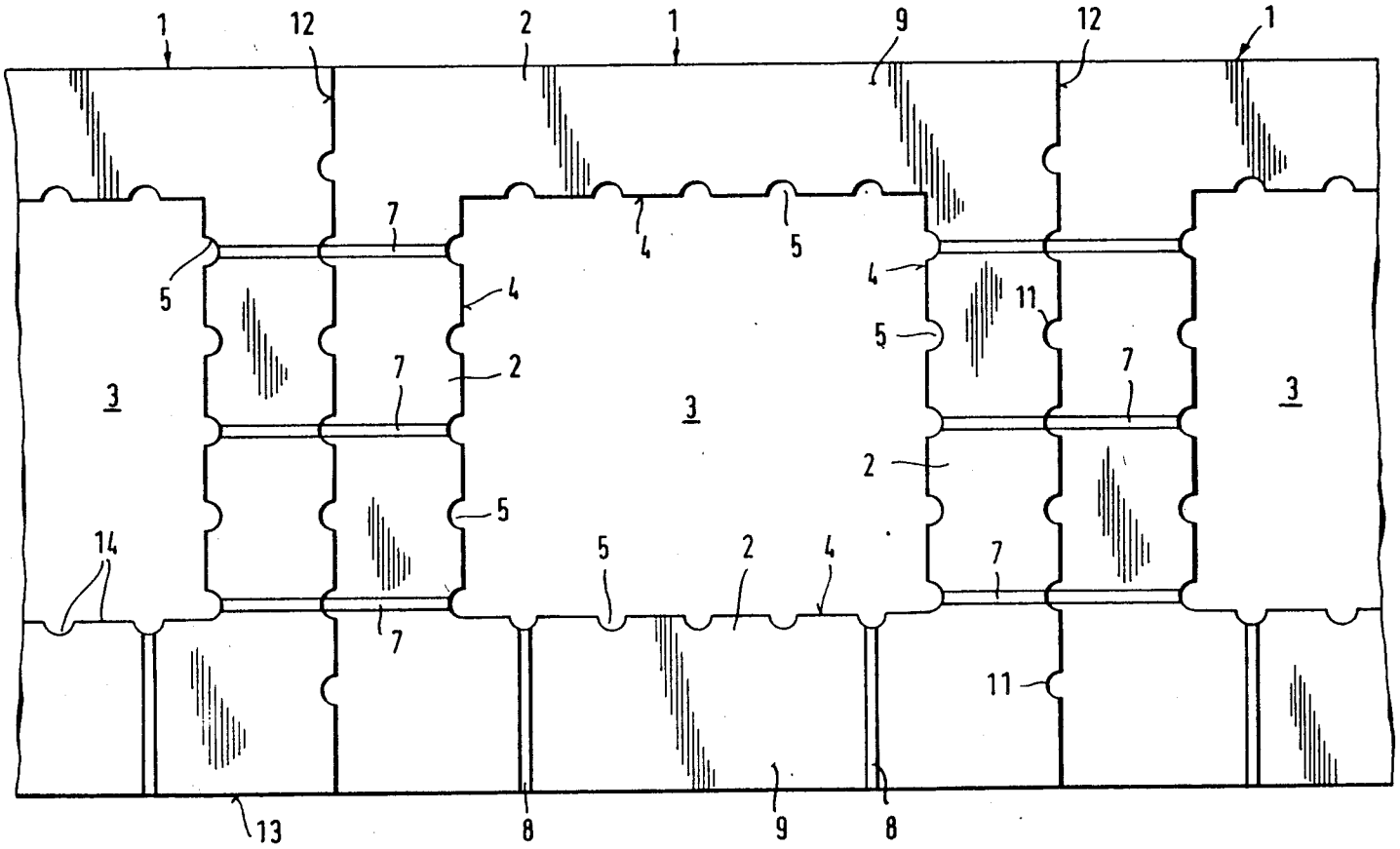
FIG. 2 shows an overhead view of a section of bricks according to an embodiment of the invention next to one another in a row.

As shown in FIG. 1, the air-cooled combustion chamber wall is constructed of a masonry wall of bricks 1, whose walls 2 enclose at least one air duct 3 running parallel to the plane of the wall 2, so that a continuous duct is formed with the identical bricks 1 located below and above. Measures are thereby taken so that the surface 13 on the combustion chamber side of the wall 2 of the brick 1 is smaller than the opposite surface 14 facing the air duct 3 of the wall 2 of the brick 1. However, not only the wall surface 14, but also the other wall surfaces 4 facing the air duct 3 in question exhibit a surface structure 5 which increases the surface area, which in the illustrated case, is formed by groove-like recesses which run in the longitudinal direction of the duct, that is, in the airflow direction. To further increase the surface area of the bricks 1 which comes in contact with the air, there are, in alternative embodiments, partitions 6 running in the airflow direction so that, as shown in each case, there are ducts 3 having two passages and even three passages. The surfaces of the partitions 6 are also provided in the illustrated case with surface structures which increase the surface area, namely groove-like recesses running in the flow direction which increase the heat transfer. Between the individual air ducts 3 of adjacent bricks 1, connecting ducts 7 are formed by the groove-like recesses provided in end surfaces 9 of the bricks 1, which combine with corresponding groove-like recesses of the adjacent bricks 1 to form a complete duct, and which transition into corresponding connecting ducts 7 laterally in one row of adjacent bricks 1.

There are also air inflow ducts 8 between the air ducts 3 and the combustion chamber, which are formed in a similar manner by groove-like recesses in the end surfaces 9, which combine to form complete ducts. To improve the stability of the wall structure, the bricks 1 are laid in a staggered fashion, that is, offset from row to row. Adjacent bricks are engaged with one another by means of serrations. The bricks are engaged with one another by means of tongue and groove joints 11 in the side wall outside surfaces 12. The tongue and groove joints 11 also essentially run in the longitudinal direction of the flow, which prevents a shifting of the bricks 1 in relation to one another perpendicular to the principal plane of the wall. In addition, or instead, there can also be tongue and groove joints in the end surfaces 9 of the bricks 1 parallel to the principal plane of the wall, so that not only is the mutual shifting of the bricks 1 in one row prevented, but also a mutual shifting of the bricks 1 from row to row. As shown in FIG. 1, between or on the bricks 1 provided with ducts 3, there are blocks 10 which have no air ducts. These blocks can serve as a secure attachment for anchoring elements, in the form of pins A and metal loops B, for the fastening of the masonry structure to an additional protective or support structure (not shown), or can also be used to close off the ends of the ducts 3. The blocks 10 can also, like the bricks 1, be engaged with one another and with the bricks by means of serrations. The bricks 1 and the blocks 10 preferably have a height of 64 mm, a depth of 125 mm and a width of 250 mm, or a height, depth and width which increases in increments of these standard dimensions or a multiple of them, so that they can be installed simply by addition in so-called standard formats in an identical grid. The bricks 1 and the blocks 10 preferably comprise SiC. They can be mortared with refractory mortar containing SiC.

Figure 3:
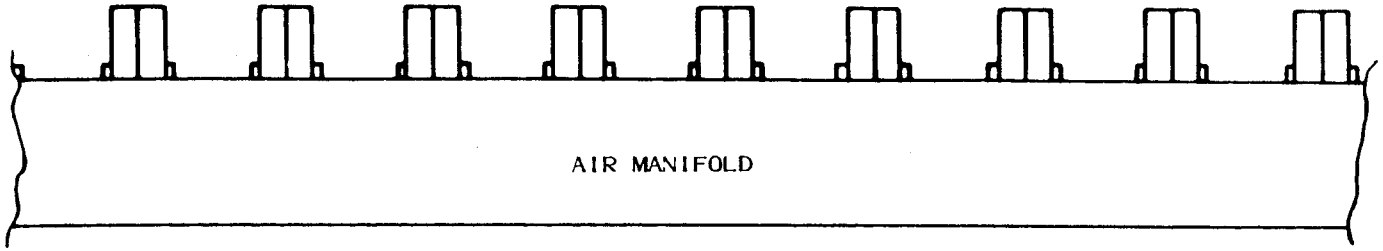
FIG. 3 shows a portion of a wall assembled, at least partially, with bricks according to an embodiment of the invention.

FIG. 3 shows a portion of a wall assembled, at least partially, with bricks according to an embodiment of the invention. The embodiment of the invention has an air manifold which collects the air from the openings through which extend vertically through the bricks. Alternatively, a similar structure could be used to inject air into openings within the bricks, which air would then flow into the combustion chamber and the passages between the bricks.

Figure 4:
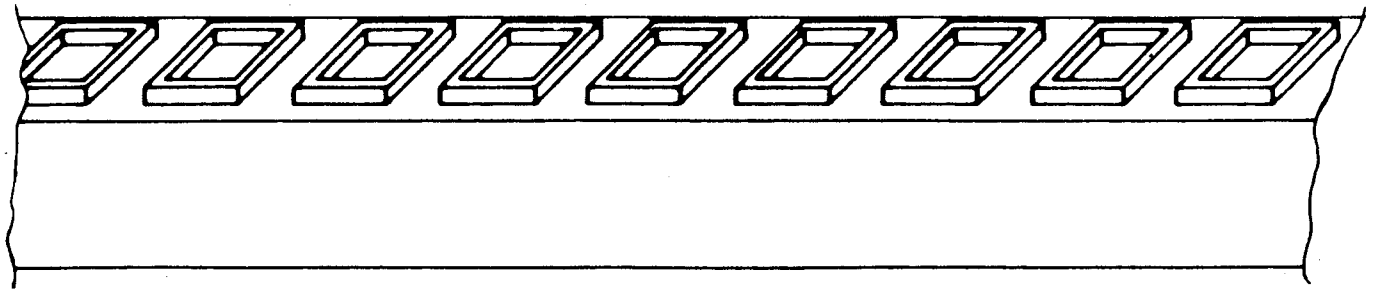
FIG. 4 shows another embodiment of a wall assembled, at least partially, with bricks according to an embodiment of the invention.

FIG. 4 shows another embodiment of a portion of a wall assembled, at least partially, with bricks according to an embodiment of the invention. FIG. 4 is a three-dimensional drawing of a portion of a wall according to an embodiment of the invention. This Figure could also represent an air manifold similar to the one shown in FIG. 3.

The invention as described hereinabove in the context of the preferred embodiments is not to be taken as limited to all of the provided details thereof, since modifications and variations thereof may be made without departing from the spirit and scope of the invention.

What is claimed is:

1. An air-cooled wall of a combustion furnace, said wall comprising:

a plurality of brick means disposed one substantially adjacent another;

at least a portion of said brick means comprising brick;

each said brick having at least one passage being disposed within and extending through its corresponding brick for passing cooling air therethrough;

each said brick having at least one inner surface and at least one outer surface;

one of said at least one outer surface comprising at least one surface disposed adjacent a combustion area of said combustion furnace;

said at least one passage comprising at least a portion of said at least one inner surface;

said at least one air passage being disposed when said plurality of bricks form a wall, such that, said at least one air passage is disposed to accept air from an adjacent one of said bricks and pass at least a portion of said air to another, also adjacent, one of said bricks;

each said brick having means for forming at least one air connection; and said at least one air connection being connected to at least one of said air passages, said at least one air connection for connecting at least one of said air passages to said at least one outer surface disposed adjacent a combustion area of said combustion furnace, said means for forming said at least one air connection being disposed, in said wall, adjacent to a corresponding means for forming an air connection of an adjacent brick in said wall.

2. An air-cooled wall of a combustion furnace, said wall comprising:

a plurality of bricks disposed one substantially adjacent another;

each said brick having at least one passage being disposed within and extending through its corresponding brick for passing cooling air therethrough;

each said brick having at least one inner surface and at least one outer surface;

one of said at least one outer surface comprising at least one surface disposed adjacent a combustion area of said combustion furnace;

said at least one passage comprising at least a portion of said at least one inner surface;

said at least one air passage being disposed when said plurality of bricks form a wall, such that, said at least one air passage is disposed to accept air from an adjacent one of said bricks and pass at least a portion of said air to another, also adjacent, one of said bricks;

each said brick having means for forming at least one air connection; and said at least one air connection being connected to at least one of said air passages, said at least one air connection for connecting at least one of said air passages to another of said air ducts, said means for forming said at least one air connection being disposed, in said wall, adjacent to a corresponding means for forming an air connection of an adjacent brick.

3. The air-cooled wall of a combustion furnace according to claim 1, wherein said at least one air passage in each said brick comprises a plurality of passages, and at least one of said plurality of passages each being connected to a corresponding passage in a plurality of adjacent bricks in said wall.

4. The air-cooled wall of a combustion furnace according to claim 1, wherein said at least one outer surface, of at least some of said bricks disposed at a side of said wall facing said combustion area, is smaller in surface area than an immediately opposite inner surface facing said air passage within the corresponding brick.

5. The air-cooled wall of a combustion furnace according to claim 4, wherein said immediately opposite inner surface in its air passage has surface means for increasing surface area of its at least one corresponding air passage in said brick.

6. The air-cooled wall of a combustion furnace according to claim 5, wherein said surface means comprise recesses forming grooves in said inner surface of said brick.

7. The air-cooled wall of a combustion furnace according to claim 6, wherein said at least one air passage of each brick includes at least two partitions for separating air flow within said brick.

8. The air-cooled wall of a combustion furnace according to claim 7, wherein said surface means comprise insert structures which increase the inner surface area located within said air passages.

9. The air-cooled wall of a combustion furnace according to claim 8, including additional air connections between at least some of the adjacent air passages.

10. The air-cooled wall of a combustion furnace according to claim 9, wherein said additional air connections are disposed between neighboring bricks in said wall to connect air passages in adjacent bricks.

11. The air-cooled wall of a combustion furnace according to claim 10, wherein said additional air connections and said means for forming air connections are formed by elongated recesses in surfaces of said bricks which abut recesses in at least one other brick of said wall.

12. The air-cooled wall of a combustion furnace according to claim 11, wherein said bricks are disposed staggered, one being offset in relation to another one of said bricks from row to row.

13. The air-cooled wall of a combustion furnace according to claim 12, wherein said bricks have serrations for engaging with adjacent bricks when disposed in said wall.

14. The air-cooled wall of a combustion furnace according to claim 13, wherein a portion of each said brick comprises a side wall facing said combustion area which is thicker than at least some of its other, side walls.

15. The air-cooled wall of a combustion furnace according to claim 14, wherein some of said brick means comprise blocks adjacent the bricks, said blocks being chosen from a member of the group consisting essentially of blocks being without air passage means, blocks for anchoring said wall and to close said air passages and bricks having both characteristics of the other members of this group.

16. The air-cooled wall or a combustion furnace according to claim 15, wherein said serrations on said bricks comprise tongue and groove joints in at least some of said outer wall surfaces of said bricks.

17. The air-cooled wall of a combustion furnace according to claim 16, wherein said bricks have a height, depth and width which increase in increments of multiples of 64 millimeters, 125 millimeters and 250 millimeters, respectively.

18. The air-cooled wall of a combustion furnace according to claim 17, wherein said bricks comprise silicon carbide.

19. The air-cooled wall of a combustion furnace according to claim 18, wherein said bricks are mortared together with a refractory mortar containing silicon carbide.

* * * * *